US006077116A

United States Patent [19]

Yamamoto et al.

[11] Patent Number: 6,077,116

[45] Date of Patent: Jun. 20, 2000

[54] FIXING STRUCTURE FOR ELECTRICAL CONNECTION ASSEMBLY

[75] Inventors: Masaki Yamamoto; Hiroki Shiraiwa, both of Shizuoka, Japan

[73] Assignee: Yazaki Corporation, Tokyo, Japan

[21] Appl. No.: 09/163,195

[22] Filed: Sep. 30, 1998

[30] Foreign Application Priority Data

Oct. 1, 1997 [JP] Japan ..... 9-268831

[51] Int. Cl.[7] ..... H01R 13/73

[52] U.S. Cl. ..... 439/571; 439/163; 439/165; 411/539

[58] Field of Search ..... 439/571, 573, 439/76.1, 76.2, 163, 165, 933, 561; 411/539, 541

[56] References Cited

U.S. PATENT DOCUMENTS

| | | | |
|---|---|---|---|
| 971,897 | 10/1910 | Keith | 411/539 |
| 4,288,190 | 9/1981 | Benson | 411/539 |
| 4,558,548 | 12/1985 | Hieger | 411/539 |

FOREIGN PATENT DOCUMENTS 64-20016 1/1989 Japan .

5-343121 12/1993 Japan .

*Primary Examiner*—Paula Bradley
*Assistant Examiner*—Katrina Davis
*Attorney, Agent, or Firm*—Morgan, Lewis & Bockius LLP

[57] ABSTRACT

A structure for fixing an electrical junction assembly on a corner portion defined by a first attaching surface and a second attaching surface perpendicular to the first attaching surface, the fixing structure comprises an electrical junction assembly body including a wire harness drawn out from a first side face thereof, the first side face opposing to the first attaching surface, a first bracket including a first fastening portion parallel to the first side face and a through hole formed in the first fastening portion, into which a first bolt vertically provided on the first attaching surface is inserted, a second bracket including a second fastening portion parallel to a second side face opposing to the second attaching surface, and an elongated through hole formed in the second fastening portion and extending toward the first side wall, into which a second bolt vertically provided on the second attaching surface is inserted, and a thin breakable member provided on a face of the second fastening portion which is the other side of a face to be abutted against the second attaching surface for closing a part of the elongated through hole near the first side face.

5 Claims, 6 Drawing Sheets

FIXING STRUCTURE FOR ELECTRICAL CONNECTION ASSEMBLY

BACKGROUND OF THE INVENTION

The present invention relates to a fixing structure an electrical junction assembly which is used such as when an electrical junction box or the like is installed in such a manner as to extend along two walls of a corner portion on the vehicle body side.

As conventional fixing structures for an electrical junction assembly, those shown in FIGS. 4 to 8 or one disclosed in Japanese Utility Model Publication No. Sho 64-20016 are known.

In FIGS. 4 to 6, a wire harness 5 is drawn out of one side surface 3 of an electrical junction box 1 serving as an electrical junction assembly. In addition, a first bracket 7 projecting in a direction in which the wire harness is drawn out is provided at one end of the electrical junction box 1. The first bracket 7 is provided with a bolt insertion through hole 11 and a fastening surface 9 oriented substantially in the same direction as the side surface 3 of the electrical junction box 1. The size of the through hole 11 is formed in correspondence with a bolt 15 projecting from one attaching surface 13 on the vehicle body side, and is formed slightly larger than the diameter of the bolt 15.

A second bracket 17 is projectingly provided at another end of the electrical junction box 1. The second bracket 17 has an L-shaped cross section as shown in FIGS. 5 and 6, and has a fastening surface 19 which is perpendicular to the fastening surface 9 of the first bracket 7. The second bracket 17 is provided with a bolt insertion elongated through hole 21 which is elongated along the longitudinal direction of the first bracket 7. The width of the elongated through hole 21 is formed in correspondence with a bolt 25 projecting from another attaching surface 23 perpendicular to the attaching surface 13 on the vehicle body side.

When installing, as shown in FIG. 7, the through hole 11 of the first bracket 7 is caused to be inserted by the bolt 15 on one attaching surface 13, and the overall electrical junction box 1 is rotated in the direction of arrow A in FIG. 7, the bolt 25 on the other attaching surface 23 on the vehicle body side is relatively passed diagonally through the elongated through hole 21 as shown in FIG. 8, and the bolt 25 is finally passed through the elongated through hole 21 on the upper side of the elongated through hole 21.

As a result, the electrical junction box 1 is provisionally fixed to the attaching surfaces 13 and 23 on the vehicle body side by the bolts 15 and 25 by means of the first bracket 7 and the second bracket 17. In such a state, as unillustrated nuts are fastened to the bolts 15 and 25, the electrical junction box 1 can be fastened and fixed to the attaching surfaces 13 and 23 on the vehicle body side.

However, with the above-described attaching structure, in the provisionally fixed state such as the one shown in FIG. 4, the wire harness 5 drawn out from one side surface 3 of the electrical junction box 1 produces a reaction force with respect to one attaching surface 13 on the vehicle body side, so that the electrical junction box 1 is set in a state in which the electrical junction box 1 as a whole is lifted up from the attaching surface 13. For this reason, the second bracket 17 is set in a state of being lifted up with respect to the bolt 25 on the other attaching surface 23 as shown in FIG. 6, with the result that there is a possibility that the bolt 25 fails to be positioned at the proper inserting position with respect to the elongated through hole 21. If the nut is fastened to the bolt 25 in such a state, there is a possibility of the second bracket 17 being broken, so that the operator must perform the operation of fastening the nut while pressing the electrical junction box 1 as a whole. Hence, there has been a problem in that the operational efficiency is poor.

SUMMARY OF THE INVENTION

Accordingly, an object of the present invention is to provide a fixing structure an electrical junction assembly which makes it possible to positively effect provisional fixation, excels in the operational efficiency, and makes it possible to prevent the breakage of the bracket.

In order to achieve the above object, there is provided a structure for fixing an electrical junction assembly on a corner portion defined by a first attaching surface and a second attaching surface perpendicular to the first attaching surface, the fixing structure comprising: an electrical junction assembly body including a wire harness drawn out from a first side face thereof, the first side face opposing to the first attaching surface; a first bracket including a first fastening portion parallel to the first side face and a through hole formed in the first fastening portion, into which a first bolt vertically provided on the first attaching surface is inserted; a second bracket including a second fastening portion parallel to a second side face opposing to the second attaching surface, and an elongated through hole formed in the second fastening portion and extending toward the first side wall, into which a second bolt vertically provided on the second attaching surface is inserted; and a thin breakable member provided on a face of the second fastening portion which is the other side of a face to be abutted against the second attaching surface for closing a part of the elongated through hole near the first side face.

Accordingly, when the electrical junction assembly is fitted while being rotated, the electrical junction assembly is moved in a state in which the second bolt on the second attaching surface on the vehicle body side is caused to be inserted diagonally through the elongated through hole, and the second bracket is finally passed through the insertion portion. The inserted bolt is relatively positioned by the breakable member inside the elongated through hole. Accordingly, even if the wire harness has produced a reaction force with respect to the first attaching surface, the lifting up of the electrical junction assembly is suppressed on the first side face of the electrical junction assembly, and it is possible to maintain the inserted state at the initial position without offsetting the position of the second bolt on the second attaching surface with respect to the elongated through hole. Then, as the nut is fastened to the bolt, the breakable member can be easily broken.

Besides, the breakable member may be formed integrally with the second bracket. Accordingly, the manufacture is facilitated remarkably.

Furthermore, in the side of the second fastening portion in which the breakable member is provided, the size of unclosed part of the elongated through hole is substantially equal to the diameter of the second bolt.

Accordingly, since the insertion portion of the elongated through hole closed by the breakable member has a size substantially equal to the diameter of the second bolt, the bolt passed through the elongated through hole can be relatively positioned reliably.

An electrical junction box may be served as the electrical junction assembly.

DETAILED DESCRIPTION OF THE PREFERRED EMBODIMENT

Figure 1:
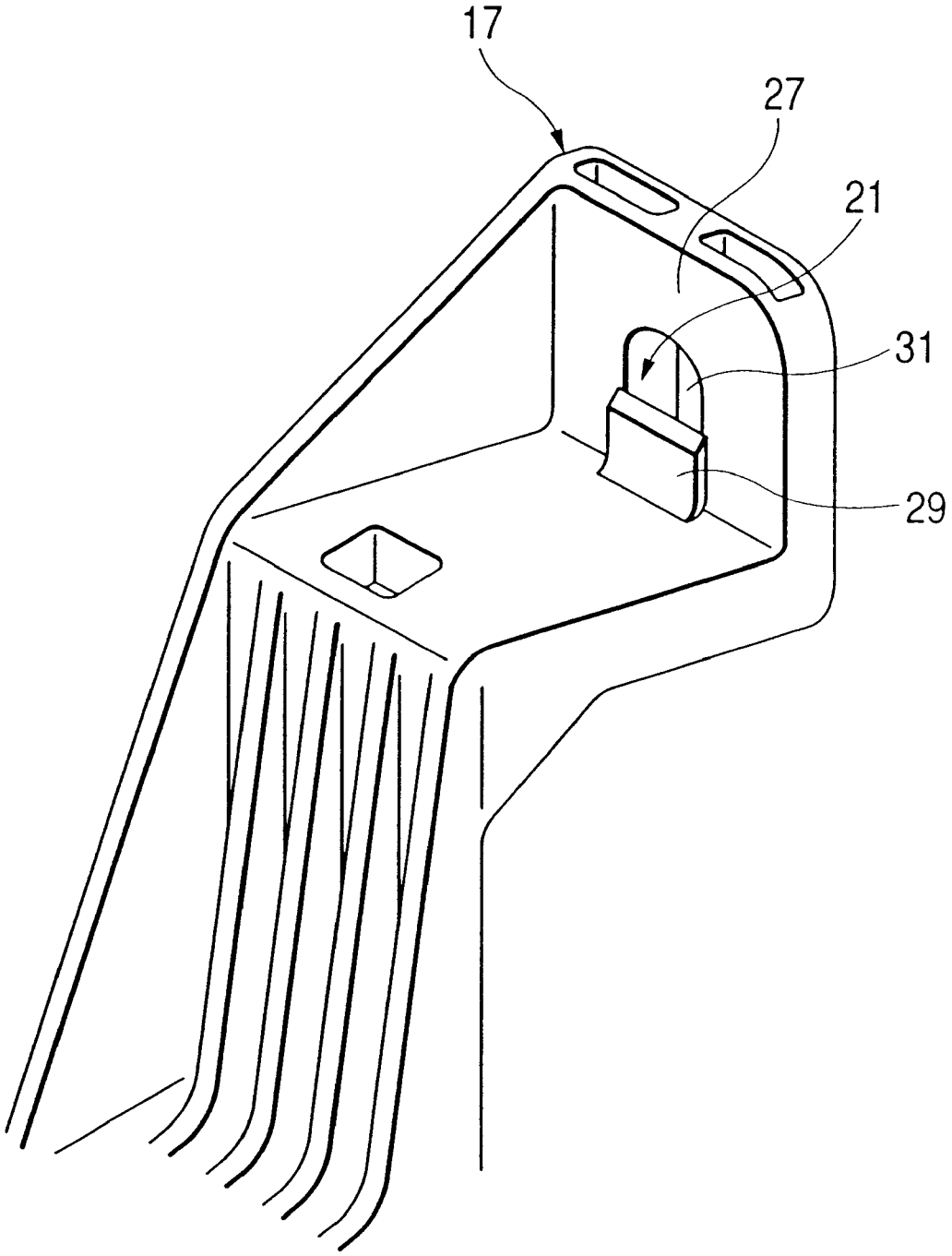
FIG. 1 is an enlarged perspective view of an essential portion in accordance with an embodiment of the present invention.
Figure 2:
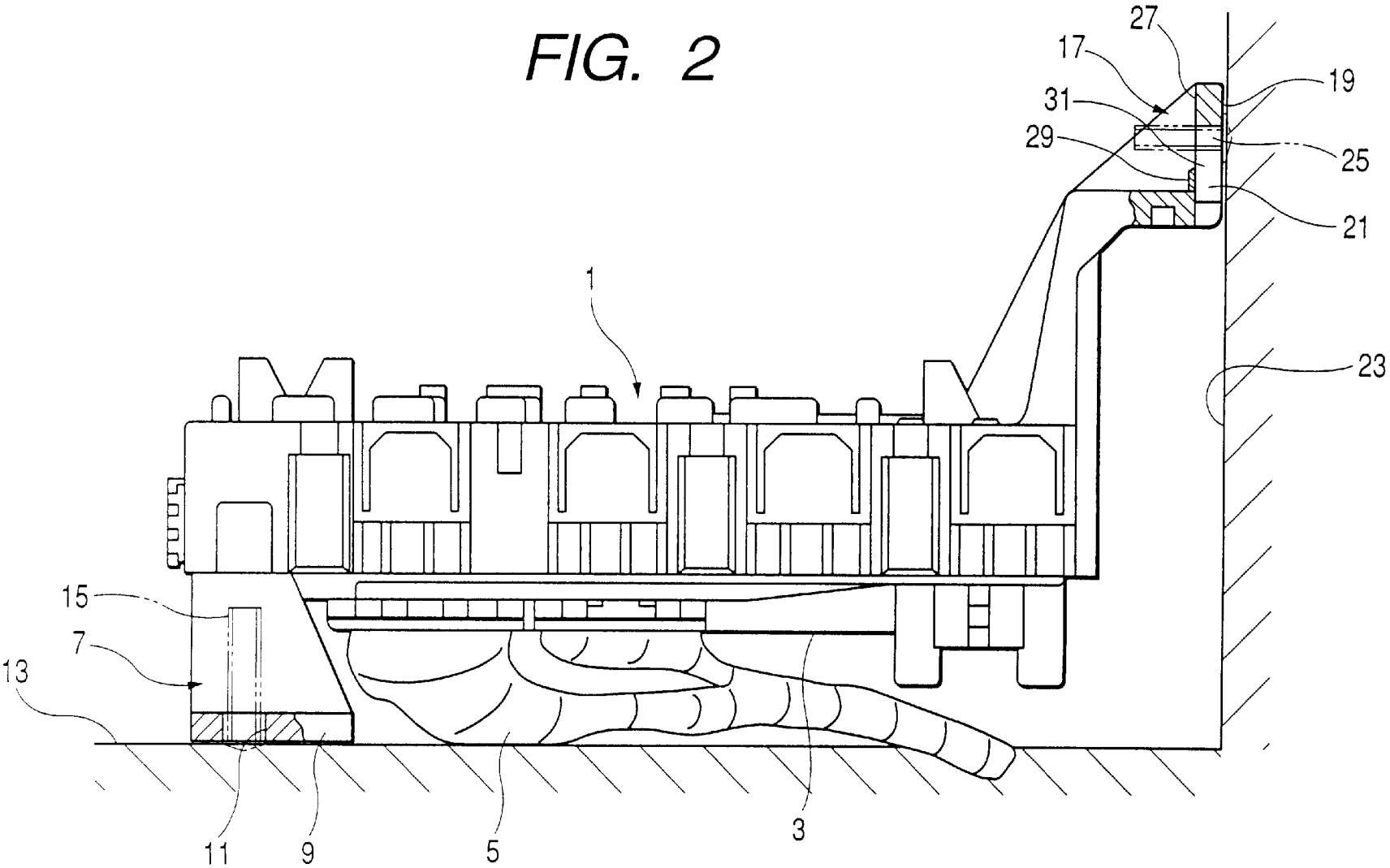
FIG. 2 is an overall side view in accordance with the embodiment of the present invention.
Figure 3:
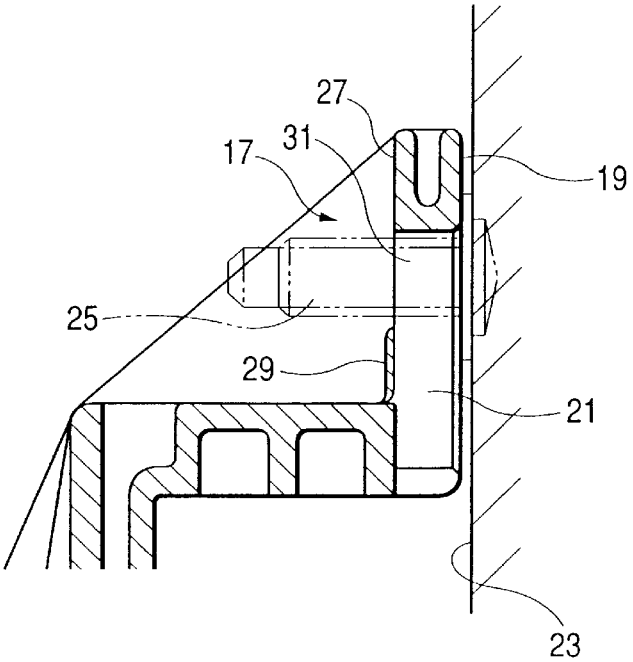
FIG. 3 is an enlarged cross-sectional view of the essential portion in accordance with the embodiment of the present invention.
Figure 5:
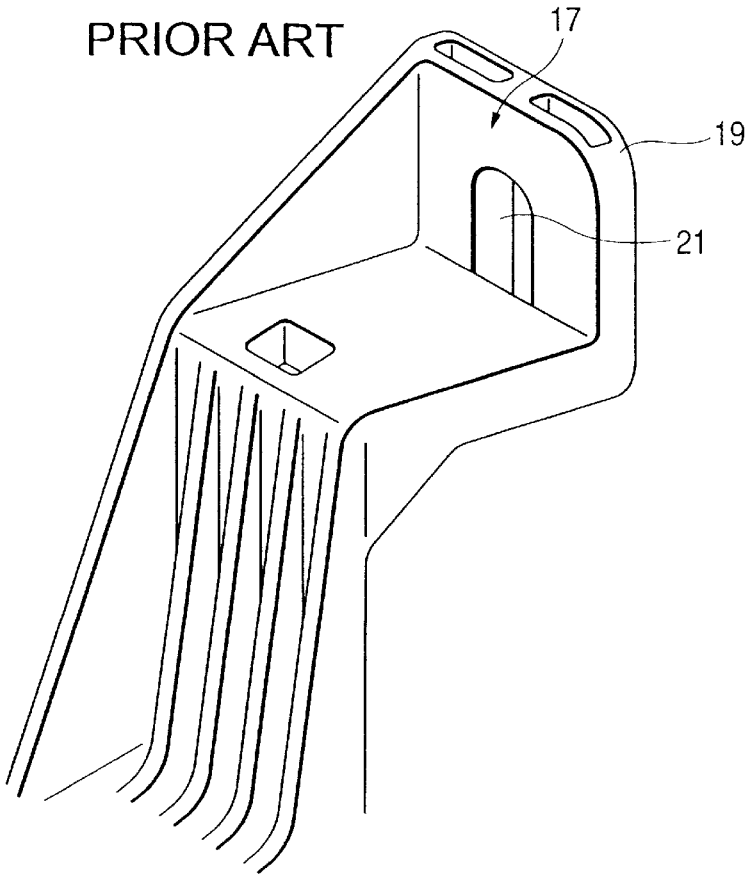
FIG. 5 PRIOR ART
FIG. 5 is an enlarged perspective view of an essential portion of the conventional structure.
Figure 4:
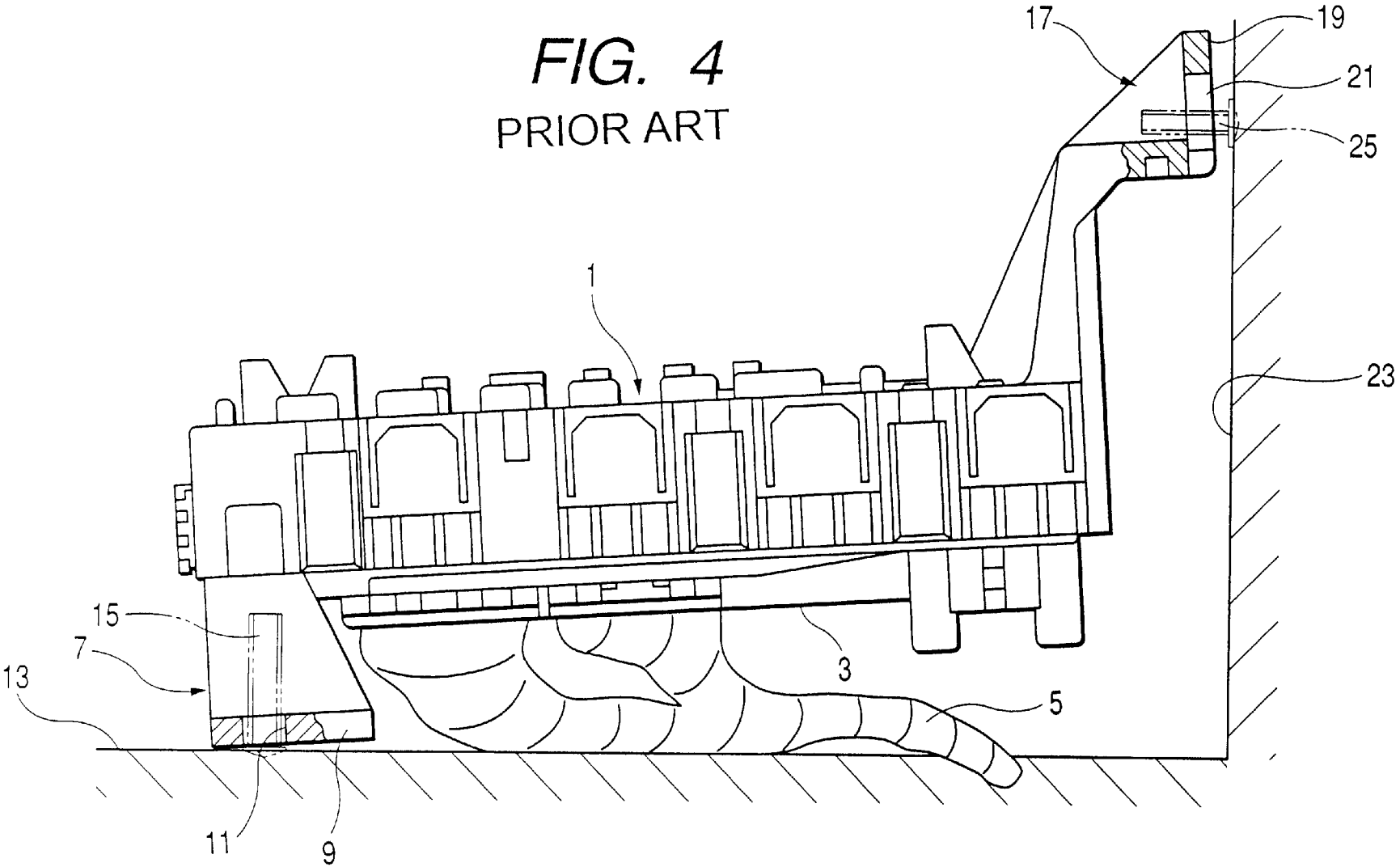
FIG. 4 PRIOR ART
FIG. 4 is an overall side view of a conventional structure.
Figure 6:
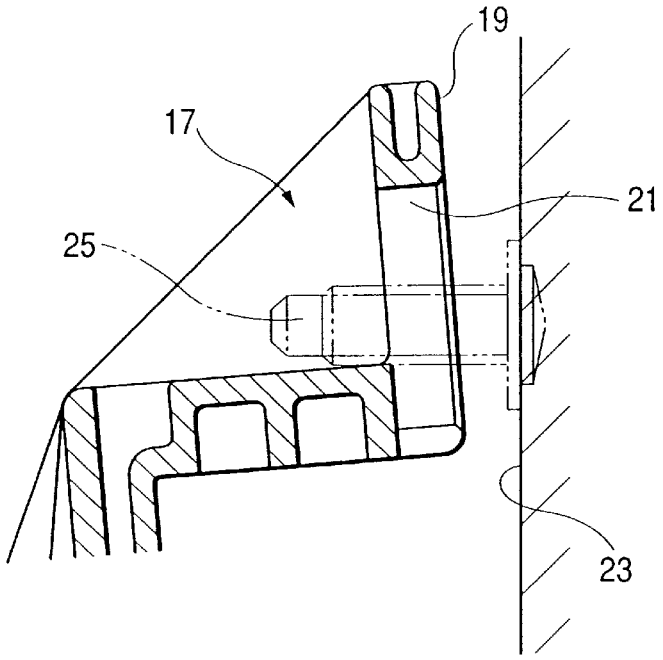
FIG. 6 PRIOR ART
FIG. 6 is an enlarged cross-sectional view of the essential portion of the conventional structure.

FIGS. 1 to 3 show an embodiment of the present invention, in which FIG. 1 is an enlarged perspective view of an essential portion, FIG. 2 is an overall side view, and FIG. 3 is an enlarged cross-sectional view of the essential portion. It should be noted that component parts corresponding to those in FIGS. 4 to 8 are denoted by the same reference numerals, and an overlapping description will be omitted.

In this embodiment, in particular, a thin breakable member 29 is provided on a surface 27 of the second bracket 17 which is opposite to the fastening surface 19 thereof. The breakable member 29 is formed integrally with the second bracket 17. A portion of the elongated through hole 21 is closed by the breakable member 29 on one side in the direction of the elongated through hole on the surface 27 side, i.e., on the lower side in FIG. 1. As a result, an insertion portion 31 is left in an upper portion of the elongated through hole 21. The size of the insertion portion 31 is formed to be substantially equal to the diameter of the bolt 25. Accordingly, the second bracket 17 can be provisionally fixed positively as the bolt 25 is inserted in the insertion portion 31.

Figure 8:
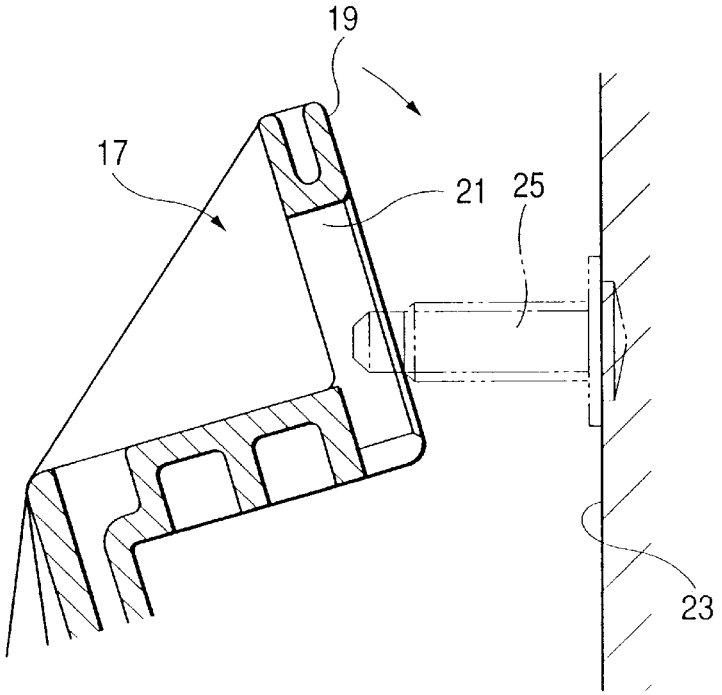
FIG. 8 PRIOR ART
FIG. 8 is an enlarged cross-sectional view illustrating the process of installation in accordance with the conventional structure.
Figure 7:
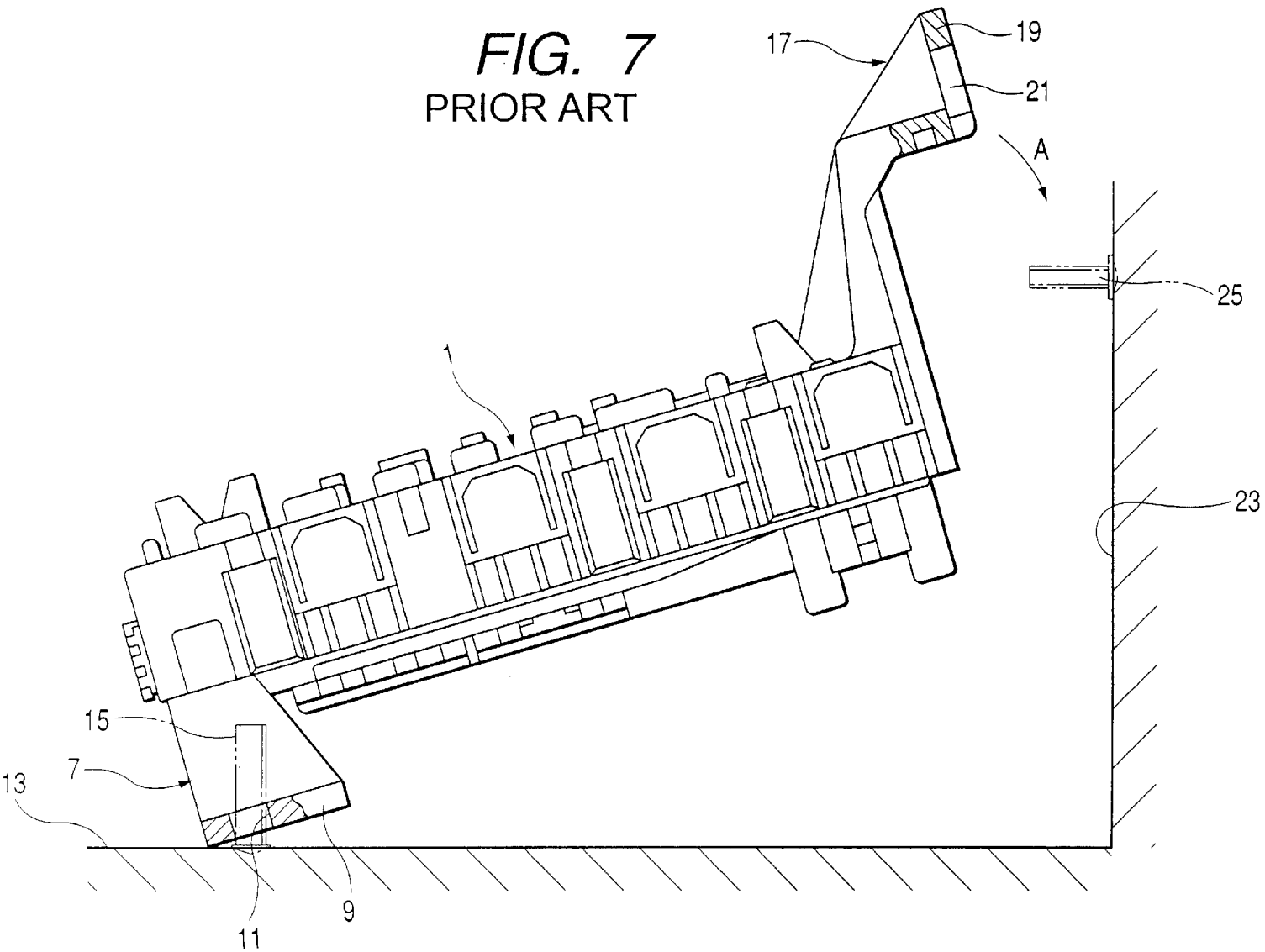
FIG. 7 PRIOR ART
FIG. 7 is an explanatory diagram illustrating a process of installation in accordance with the conventional structure.

In such a structure, if the electrical junction box 1 is attached to the attaching surfaces 13 and 23 on the vehicle body side in a procedure similar to that shown in FIGS. 7 and 8, the bolt 25 on the attaching surface 23 is relatively moved diagonally from the lower side to the upper side in the elongated through hole 21 from the fastening surface 19 side toward the surface 27 side, and is passed through the insertion portion 31, as shown in FIG. 3.

In this inserted state, when the second bracket 17 tends to move upward, the breakable member 29 is engaged with the bolt 25, and the second bracket 17 is positioned and is set in a provisionally fixed state.

Accordingly, even if the wire harness 5 has produced a reaction force with respect to the attaching surface 13 in the provisionally fixed state of the electrical junction box 1, the provisionally fixed state of the second bracket 17 such as the one shown in FIG. 3 does not change, so that positioning can be effected reliably.

As the unillustrated nuts are fastened to the bolts 15 and 25, the brackets 7 and 17 can be fixed reliably to the attaching surfaces 13 and 23, and the electrical junction box 1 can be attached positively. For this reason, it is possible to reliably prevent the breakage of the second bracket 17 and the like.

In addition, the breakable member 29 is easily broken by the fastening of the unillustrated nut to the bolt 25, and reliable installation is made possible without affecting the fastening of the second bracket 17 to the attaching surface 23 by means of the bolt and the nut.

It should be noted that the insertion portion 31 can be formed slightly larger than the diameter of the bolt 25. As for the breakable member 29, one which is formed separately from the second bracket 17 can also be fixed by bonding or the like. When a separate breakable member 29 is set, it is possible to appropriately select its material, and the breakable member 29 can be made more easily breakable or softer to the extent that its resilience is not overcome by the reaction force of the wire harness 5.

As has been described heretofore, according to the present invention, the positioning of the second bracket of the electrical junction assembly with respect to the bolt on the attaching surface side can be effected reliably, and it is possible to prevent damage to the bracket during fastening of the nut. In addition, the breakable member can be easily broken by the fastening of the nut, and the fastening of the second bracket by the bolt and the nut is not affected.

If the breakable member is formed integrally with the second bracket, the manufacture of the breakable member is facilitated remarkably, and the breakable member can be manufactured at low cost.

Due to fact that the size of the insertion portion is formed to be substantially equal to the diameter of the bolt, the positioning can be effected more reliably, and the breakage of the bracket during tightening of the nut can be prevented reliably.

An electrical junction box may be served as the electrical junction assembly.

What is claimed is:

1. A structure for fixing an electrical junction assembly on a corner defined by an intersection of a first attaching surface and a second attaching surface perpendicular to the first attaching surface, the structure comprising:

an electrical junction assembly body including a wire harness drawn out from a first side face thereof, the first side face opposing to the first attaching surface;

a first bracket including a first fastening portion parallel to the first side face and a through hole formed in the first fastening portion, into which a first bolt extending substantially perpendicular to the first attaching surface is inserted;

a second bracket including a second fastening portion parallel to a second side face opposing to the second attaching surface, and an elongated through hole formed in the second fastening portion and extending toward the first side face, into which a second bolt extending substantially perpendicular to the second attaching surface is inserted; and a thin breakable member provided on a face of the second fastening portion which is on the opposite side of the second fastening portion from the second side face to be abutted against the second attaching surface, the thin breakable member closing a part of the elongated through hole positioned at an end of the elongated through hole toward the first side face.

2. The structure as set forth in claim 1, wherein a size of a part of the elongated through hole that is not closed by the breakable member is substantially equal to the diameter of the second bolt.

3. The structure as set forth in claim 1, wherein an electrical junction box is provided as the electrical junction assembly.

4. The structure as set forth in claim 1, wherein the breakable member is formed integrally with the second bracket.

5. The structure as set forth in claim 4, wherein a size of a part of the elongated through hole that is not closed by the breakable member is substantially equal to the diameter of the second bolt.

* * * * *